United States Patent [19]

Chachin et al.

[11] Patent Number: 4,977,707

[45] Date of Patent: Dec. 18, 1990

[54] DEVICE FOR EXTERNAL MAGNETIC ABRASIVE MACHINING OF CYLINDRICAL COMPONENTS

[76] Inventors: Viktor N. Chachin, ulitsa Kulman, 15, kv. 91; Nikolai S. Khomich, ulitsa Karbysheva, 11, kv. 10, both of Minsk; Lel K. Druzhinin, 1 Peschany pereulok, 4, kv. 326, Moscow; Igor A. Shlepov, ulitsa Vershinina, 4, kv. 2, Moscow; Rostislav O. Dulgier, ulitsa Chernyakhovskogo, 9 korpus 3, kv. 260, Moscow; Boris A. Steblovsky, Volgogradskaya ulitsa 9, kv. 57, Kiev; Viktor P. Budnik, ulitsa Gogolya, 58, kv. 179, Kievskaya oblasti Boyarka; Nikolai P. Morozov, ulitsa Korsh-Sablina, 24, kv. 2, Minsk; Vitaly V. Babuk, 2 pereulok Bagrationa, 19, kv. 343, Minsk; Alexandr P. Tarun, ulitsa Kiseleva, 7, kv. 3, Minsk, all of U.S.S.R.

[21] Appl. No.: 382,621

[22] Filed: Jan. 5, 1989

[51] Int. Cl.[5] ..... B21B 45/04

[52] U.S. Cl. ..... 51/18; 51/317; 51/318; 51/DIG. 10

[58] Field of Search ..... 51/18, 317, 328, DIG. 10

[56] References Cited

FOREIGN PATENT DOCUMENTS 787131 12/1980 U.S.S.R. .
973208 11/1982 U.S.S.R. .
975134 11/1982 U.S.S.R. .

*Primary Examiner*—Frederick R. Schmidt
*Assistant Examiner*—M. Rachuba
*Attorney, Agent, or Firm*—Burgess, Ryan and Wayne

[57] ABSTRACT

The essence of the device resides in the fact that an electromagnetic system is provided with an additional pair (3) of pole pieces (5) mounted opposite a first pair (2) and displaced into respect to the latter, lengthwise a longitudinal axis ($0_1$—$0_1$) of a component (15) to be machined, for a distance L=(0.2 to 1.0)D, where D is the diameter of the pole pieces, said pole pieces (4;5) in each of the pairs (2,3) being kinematically associated with each other, set on a common axis of rotation (0—0) and featuring an oppositely directed eccentricity (e) with respect to that axis.

1 Claim, 2 Drawing Sheets

DEVICE FOR EXTERNAL MAGNETIC ABRASIVE MACHINING OF CYLINDRICAL COMPONENTS

FIELD OF THE INVENTION

The present invention relates generally to abrasive machining of components and more specifically, to a device for external magnetic machining of cylindrical components.

PRIOR ART

Known in the present state of the art is a device for cleaning the wire stock by pulling it through a ferromagnetic abrasive powder compressed between two disks (cf., SU, A 787,131). One of the disks can be made to rotate and is provided with flanges for powder retention. The other disk is spring-loaded and serves for mechanical compression of the abrasive powder in the machining zone.

The aforementioned prior-art device fails to provide high-quality machining of wire stock, particularly in the case of wire made of wrought or touch alloys, since the abrasive powder tends to jam in the machining zone, which leads to impregnation of the surface to be machined with the abrasive powder. This tendency can be prevented by reducing the pressure exerted by the compression disk on the abrasive powder, though the process efficiency will be substantially reduced.

The closest to the herein proposed invention is a device for external magnetic abrasive machining of cylindrical components, particularly for cleaning the wire stock or large-sized rolled stock from scale or rust (cf., SU, A, 975,134).

The latter of the known devices mentioned hereinbefore comprises an electromagnetic system incorporating a pair of pole pieces mounted opposite each other so as to form an annular working zone, and a mechanism for feeding the wire or large-sided stock longitudinally into the working zone.

The pole pieces incorporated in this known device are shaped as disks axially aligned with respect to the electromagnetic coil and fitted opposite each other in the end faces thereof, and provided with central holes to allow passage for the wire or large-sized stock.

The space provided inside the coil between the pole pieces is filled with a ferromagnetic abrasive powder, and the pole pieces are protected from the outside by non-magnetic covers.

As commonly known, when an electric current is passed through an electromagnetic coil a magnetic field is generated around the coil, and, once onside the coil, the magnetic lines of force are aligned parallel with its axis. The ferromagnetic abrasive powder particles disposed inside the coil are magnetized to form trains aligned along the magnetic lines of force. Particles of the ferromagnetic abrasive powder are oriented with their longer axes along the magnetic lines of force. As bar or wire stock is pulled through the central holes provided in the pole pieces, lengthwise the coil axis, the abrasive powder particle trains are distorted and displaced radially thereby producing new, more compact trains lined up in the direction of magnetic lines of force. This leads to snagging of the surface to be machined with the abrasive particles whereby the component is stripped of its superficial layer. However, machining is effected only by particles belonging to trains immediately adjacent to the magnetic lines of force. As the cutting edges of the particles frow dull, the machining conditions are deteriorated. Inasmuch as the aforesaid prior-art device fails to offer facilities for reconditioning of the cutting ability of the particles, the latter grow dull rapidly, which sharply reduces the process efficiency and the quality of surface machined. Furthermore, snagging of the surface to be machined by the abrasive particles produces microswarf which gets mixed with the abrasive powder rather than being removed from the machining zone, which also impairs the cutting ability of the abrasive powder. Thus, a limited number of abrasive particles involved in actual machining; contamination of powder with swarf; a low pressure exerted by the abrasive particles on the surface to be machined caused by the fact that magnetic lines of force are aligned parallel with the direction of feed of the component, result in a rapid loss of the cutting ability of the ferromagnetic abrasive powder and in irregular machining lengthwise cylindrically shaped components, particularly wire or bar stock.

SUMMARY OF THE INVENTION

The present invention is aimed at the provision of a device for external magnetic abrasive machining of cylindrical components wherein the constructional embodiment of the electromagnetic system and the arrangement of the pole pieces would be made in such a way as to ensure complete and uniform removal of scale and oxide films from the entire surface of the component, resulting in substantial improvements in the efficiency and quality of magnetic abrasive machining.

The above-said aim is accomplished due to the fact that in a device for external magnetic abrasive machining of cylindrical components comprising an electromagnetic system incorporating a pair of pole pieces mounted opposite each other so as to form an annular working zone, and a mechanism for feeding the component longitudinally into the working zone, according to the invention, the electromagnetic system is provided with an additional pair of pole pieces mounted opposite the first pair and displaced with respect to the latter lengthwise the longitudinal axis of the component to be machined for a distance $L=(0.2 \text{ to } 1.0)D$, where D is the diameter of the pole pieces, said pole pieces in each pair being kinematically associated with each other, set on a common axis of rotation and featuring oppositely directed eccentricity with respect to that axis.

The pole pieces are mounted in such a manner that magnetic lines of force thread the annular working zone in a direction square with that of feed of component. The abrasive powder particles line up in trains along the magnetic lines of force so as to produce a maximum pressure effect on the surface to be machined.

With the pole pieces rotating, the abrasive powder particles forming an annular "cutting brush" run up against the surface of component to be machined whereby a pressure is brought upon this surface, producing an abrasive action and forcing the component inwards, between the pole pieces. Upon further rotation of the pole pieces, the powder particles come out of contact with the component surface to be machined and return to their primary state so as to form again the initial snagging cluster of particles shaped as an annular "cutting brush". The pairwise mounted pole pieces are shaped like bowls, which enables a maximal magnetic induction between the outer edges of the pole pieces whereby the particles are encouraged to return to their initial state. As the pole pieces keep on rotating, the component surface is being continuously snagged by the particles contacting it, while reconditioning (restoration) of the "cutting brush" comprised of the abrasive powder particles occurs at the diametrically opposite portions of the edges of the pole pieces.

As a consequence of continuous restoration of the annular "cutting brush", its constituent particles are constantly reoriented in the space changing their attitude with respect to the surface to be machined. Therefore, practically all cutting edges of the "brush" particles are involved in the snagging process, which extends abrasive powder durability and improves the process efficiency.

If the component (such as wire or bar stock) is advanced without rotation, only half of its surface will be machined by a single pair of pole pieces. Complete machining will be provided if another pair of pole pieces is mounted opposite the first pair and displaced in relation to the latter lengthwise the component axis for a distance L. The amount of L has a significant effect on the snagging process characteristics.

If L is small ($L<0.2D$, where D is the diameter of the pole pieces), the magnetic fields produced by each pair of the pole pieces will interact resulting in a reduction in the machining efficiency. A relatively large L ($L>1.0D$) leads to greater overall dimensions of the device, increased magnetic resistance of the magnetic circuit components, and decreased magnetic induction in the working zone, whereby the process intensity is reduced.

BRIEF DESCRIPTION OF THE ACCOMPANYING DRAWINGS

In what follows the present invention will now be disclosed in a detailed description of an illustrative embodiment thereof with reference to the accompanying drawings, wherein.

BEST MODE OF CARRYING OUT THE INVENTION

Figure 1:
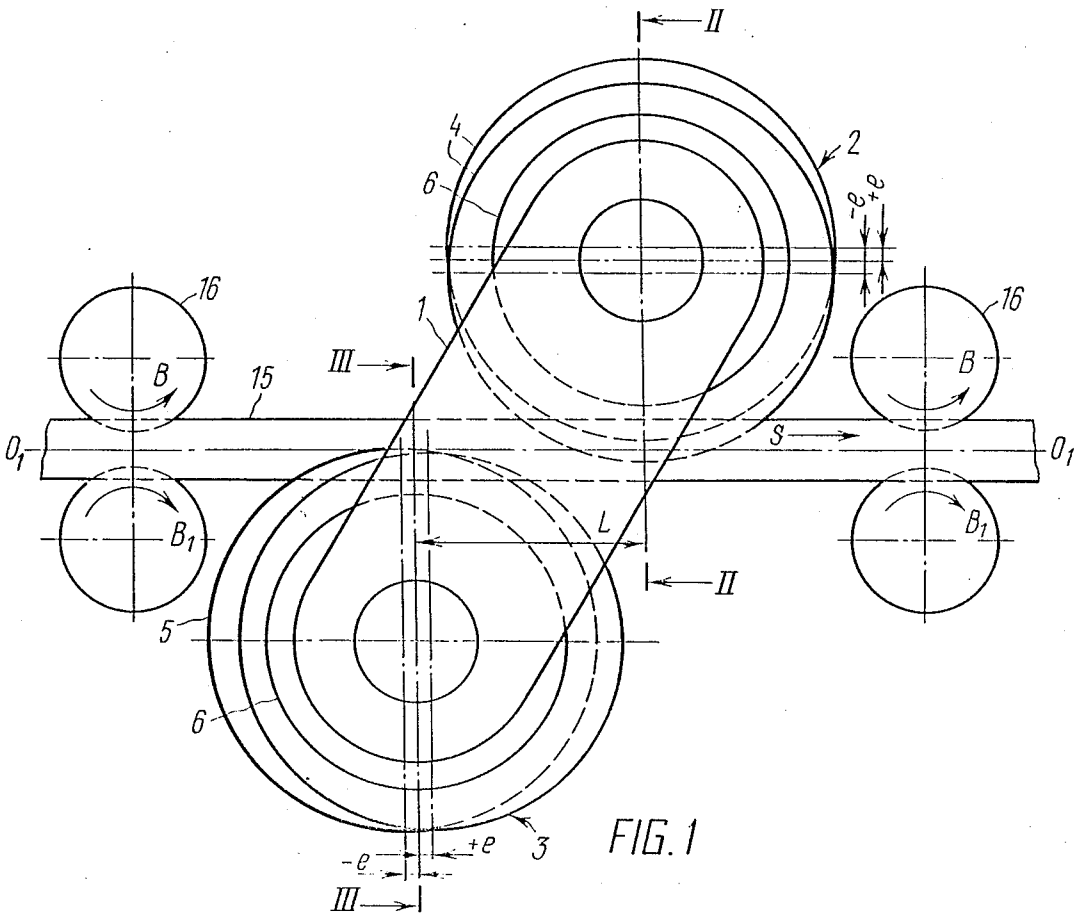
FIG. 1 is a cross sectional view of an elementary schematic of a device for external magnetic abrasive machining of cylindrical components, according to the invention.
Figure 2:
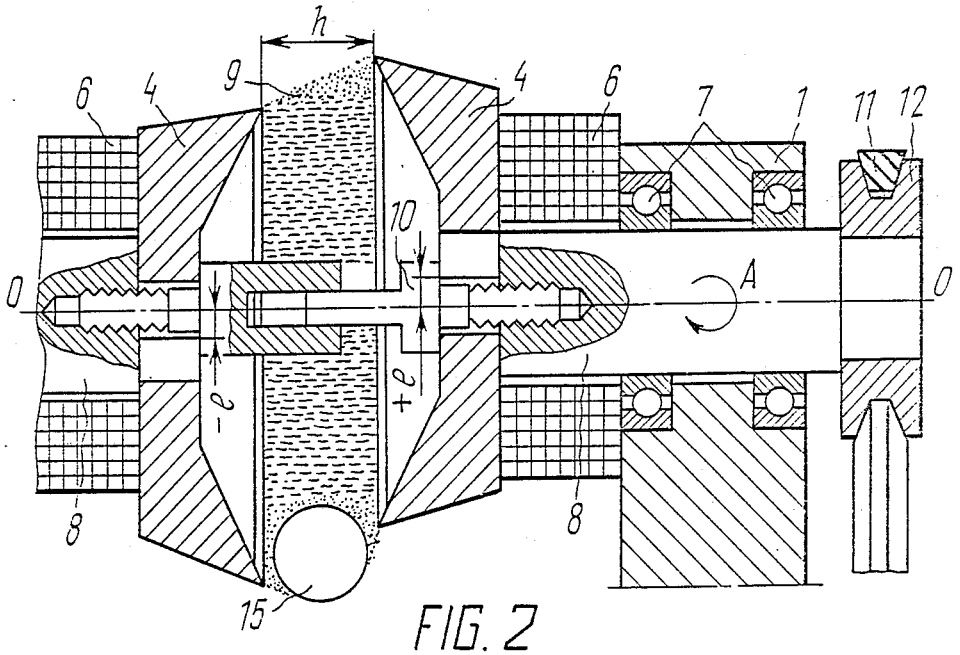
FIG. 2 is a cross section taken on the line II-II in FIG. 1.
Figure 3:
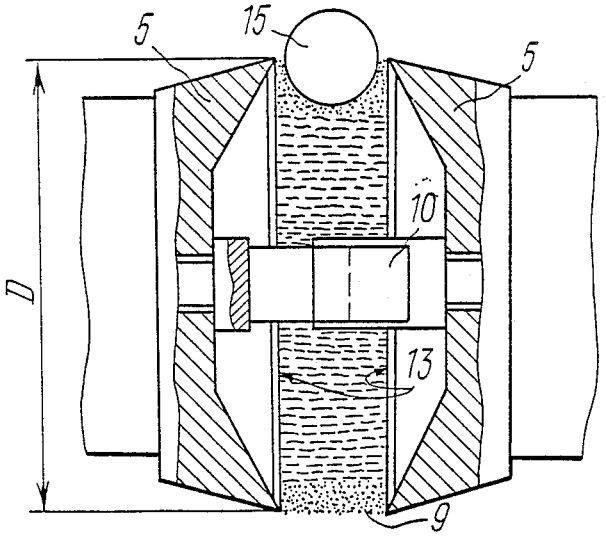
FIG. 3 is a cross section taken on the line III-III in FIG. 1.

The herein proposed device for external magnetic abrasive machining of cylindrical components, as for example shown in FIG. 1, comprising a magnetic yoke 1 installed, as for example on the machine base (which is omitted from FIG. 1), and two pairs 2 and 3 consisting of pole pieces 4 (FIG. 2) and 5 (FIG. 3). The magnetic yoke 1 carries electromagnetic coils 6 (FIG. 2) connected to a direct current source. The magnetic yoke 1 incorporates bearings 7 supporting shafts 8. In each of the pairs 2 and 3, the pole pieces 4 and 5, respectively, are mounted on the shafts 8 opposite each other so as to form a working zone 9. For each of the pairs 2 and 3, the pole pieces 4 and 5 are kinematically associated with each other through brackets 10 made substantially as screws by means of which the pole pieces 4 and 5 are held to the shafts 8.

The device comprises a drive mechanism (omitted from FIG. 1) for rotating the pole pieces 4 and 5, which are rotated (in a direction along an arrow A as seen in FIG. 2) by a belt drive 11 via a pulley 12 installed on the shaft 8.

A clearance h is provided between the pole pieces 4 and 5 in the pairs 2 and 3 which are set on a single axis of rotation O—O and spaced apart from the axis a distance e in opposite directions. The interspace between end faces 13 of the pole pieces 4 and 5 is filled with a ferromagnetic abrasive powder 14.

A longitudinal feed mechanism incorporating rollers 16 is provided in the device for feeding a component 15. A drive mechanism for rotating the rollers 16 is not shown intentionally.

For complete machining of the component 15, as for example shown in FIG. 1, the pair 2 of the pole pieces 4 is spaced apart from the pair 3 of the pole pieces 5 a distance L, lengthwise, the axis O—O of the component 15. The distance L is spcified to be within the range of (0.2 to 1.0)D, where D is the diameter of the pole pieces 4 and 5.

If $L<0.2D$, the magnetic fields produced by the pairs 2 and 3 of the pole pieces 4 and 5 will interact interrupting the continuity of the working zones 9. If $L>1.0D$, the magnitude of magnetic induction in the working zone 9 is reduced.

The herein proposed device operates as follows. An electric current passing through the electromagnetic coils 6 produces an electromagnetic field around the coils 6 whereby the pole pieces 4 and 5 are magnetized. Under the effect of the magnetic field the powder 14 is compressed in the gaps h between the pole pieces 4 and 5 so that two annular working zones 9 are formed. The pole pieces are set in rotation from the belt drives 11 through the agency of the shafts 8, and pulleys 12. The rollers 16 rotating in directions as indicated by the arrows B and $B_1$ impart a forward motion along the arrow S, lengthwise the axis O—O, to the wire stock to be machined whereby the latter is advanced between the pairs 2 and 3 of the pole pieces 4 and 5 in such a manner that its axis O—O is a tangent to the outer surfaces of the annular working zones 9 filled with the abrasive powder 14.

When the pole pieces 4 and 5 of the pairs 2 and 3 are set set on a single axis of rotation O—O, each of the pairs 2 and 3 performs machining of its respective half portion of the surface of the wire stock 15. Stock removal is less intensive at the borderlines of these halves than at other portions of the surface machined. For effective machining of the complete surface and uniform stock removal, the pole pieces 4 and 5 in each of the pairs 2 and 3 are offset oppositely with respect to the axis of rotation O—O so that they are spaced a distance e apart from the axis in opposite directions. When rotated, the pairs 2 and 3 of the pole pieces 4 and 5 display an oppositely directed radial runout by means of which the powder particles tend to execute an oscillating motion circumscribing a circle about the surface to be machined. As a result, an area larger than just one half the surface of the component 15 will be machined by each of the pairs 2 and 3 of the pole pieces 4 and 5. Portions of the surface machined by each of the pairs 2 and 3 will somewhat overlap one another, which ensures a more uniform snagging.

EXAMPLES OF PRACTICAL IMPLEMENTATION

EXAMPLE 1

Magnetic abrasive snagging of bar stock made of a Ti-W alloy and having a diameter of d=5 mm and an initial surface finish of $R_a$=1.0 to 0.8 μm. The snagging process conditions are as follows: linear speed of rotation of the pole pieces, 4 m/s; feed rate, 0.05 m/s; length of working gap, 1.5 mm; coil magnetic field strength, 120 A/m. Use was made of pole pieces having diameters of 146 mm, 90 mm and 122 mm which were set at a varying distance L and spaced a varying distance e in opposite directions. A Fe-TiC (40%) ferromagnetic abrasive powder having a grain size of 315/100 μm mixed with a coolant fluid was applied. The snagging results are represented in the table hereinbelow.

EXAMPLE 2

Magnetic abrasive snagging of welding wire stock made of a Al-Mg alloy having a diameter of d=1.0 mm and an initial surface finish of $R_a$=0.8 to 0.6 μm. The snagging process conditions are the same as in Example 1. The obtained results are represented in the table below.

In the aforementioned examples, the machining efficiency is estimated in terms of mass g of stock removed from unit area of the surface machined. The quality of surface finish was evaluated on the basis of surface finish $R_a$ attained after machining.

The highest values of the efficiency and surface finish were obtained in tests Nos. 5,6 and 15 to 18 (Example 1) and tests Nos. 23,24 and 33 to 36 (Example 2):

g=4.8 to 6.3 mg/sq cm and $R_a$=0.12 to 0.25 μm, as in Example 1;

g=6.0 to 8.1 mg/sq cm and $R_a$=0.10 to 0.18 μm, as in Example 2.

According to the rest results, an optimum distance between the pairs of the pole pieces is L=(0.2 to 1.0)D. If L<0.2D, the continuity of the annular powder "brush" is interrupted due to interaction of the magnetic fields of the pole pieces and the process characteristics deteriorate. If L>1.0D, the overall dimensions of the device and magnetic resistance of the magnetic circuit are increased causing a reduction in magnetic induction in the working gaps as well as in the values of g and $R_a$.

Optimum machining characteristics are provided if the eccentricity value is within the range of e=(0.3 to 3.0)d. If e<0.3d, the machining will be non-uniform around the component surface, and if e>3.0d, the annular powder "brush" will be disrupted in the course of machining, which reduces the efficiency and the quality of surface finish.

Comparative testing of the herein proposed device and a known device was conducted. Values of g=4.5 mg/sq cm and $R_a$=0.28 μm were obtained after machining of bar stock, which is 5 mm in diameter and made of a Ti-W alloy, using the known device; and values of g=5.6 mg/sq cm and $R_a$=0.21 μm were obtained after machining of bar stock, which is 1 mm in diameter and made of an Al-Mg alloy, using the herein proposed device. The testing demonstrated that the herein proposed device enables an increase in efficiency by 1.4 times and in the quality of surface finish, by 2.1–2.3 times, as compared to the prior-art device.

The herein proposed device for external magnetic abrasive machining of cylindrical components enables a high quality of surface finish to be attained through provision of an elastic contact between the machining tool (the annular brush) and the component to be machined. In operation, jamming of powder particles between the surfaces of the pole piece and the component is ruled out, which prevents powder particles from being embedded in the component and protects its superficial layer against being impregnated with the powder abrasive.

A high machining efficiency is attained due to continuous reorientation of powder particles in the annular working zone and because of the fact that practically the entire bulk of the abrasive powder is involved in the snagging process.

INDUSTRIAL APPLICABILITY

The invention may be used with particular advantage for polishing the wire and bar stock and for cleaning it from oxide films and scale.

TABLE

| Test | Variable characteristics of snagging process, mm | | | | Results of magnetic abrasive snagging | | |
|---|---|---|---|---|---|---|---|
| | D | L | d | e | $R_a$, μm | g, mg/sq cm | Particulars of surface appearance |
| No 1 | 2 | 3 | 4 | 5 | 6 | 7 | 8 |
| | | | | Example 1 | | | |
| 1 | | 15 | | 5.0 | 0.38 | 3.2 | Irregularly |
| 2 | | 29.2 | | 1.0 | 0.44 | 4.0 | machined |
| 3 | 146 | 73 | | 16.5 | 0.40 | 2.8 | surface |
| 4 | | 175 | | 15.0 | 0.30 | 3.3 | |
| 5 | | 146 | | 1.5 | 0.13 | 5.7 | Regularly machined |
| 6 | | 18 | | 15.0 | 0.25 | 5.1 | surface without micro irregularities |
| 7 | | 10 | | 1.5 | 0.42 | 3.1 | Surface is |
| 8 | 90 | 45 | | 1.0 | 0.45 | 3.4 | machined ir- |
| 9 | | 90 | | 16.5 | 0.38 | 2.7 | regularly both |
| 10 | | 100 | | 5.0 | 0.32 | 3.8 | lengthwise and roundwise, with |
| | | | 5.0 | | | | |
| 11 | | 12 | | 15.0 | 0.40 | 2.9 | occasional |
| 12 | | 24.4 | | 16.5 | 0.36 | 2.8 | unmachined |
| 13 | 122 | 135 | | 1.5 | 0.30 | 4.4 | portions |
| 14 | | 122 | | 1.0 | 0.42 | 3.2 | |
| 15 | | 70 | | 5.0 | 0.12 | 6.1 | Regularly machined |
| 16 | 146 | 29.2 | | 5.0 | 0.18 | 5.5 | surface |

TABLE-continued

| Test No 1 | Variable characteristics of snagging process, mm D 2 | L 3 | d 4 | e 5 | Results of magnetic abrasive snagging $R_a$, μm 6 | g, mg/sq cm 7 | Particulars of surface appearance 8 |
|---|---|---|---|---|---|---|---|
| 17 | 90 | 45 | | 1.5 | 0.20 | 4.8 | without macro |
| 18 | 122 | 122 | | 15.0 | 0.15 | 6.3 | irregularities such as craters, marks or scratches |
| | | | | Example 2 | | | |
| 19 | | 15 | | 0.3 | 0.33 | 4.0 | Irregularly |
| 20 | | 175 | | 1.5 | 0.26 | 4.7 | machined |
| 21 | 146 | 73 | | 0.2 | 0.34 | 5.2 | surface |
| 22 | | 146 | | 4.0 | 0.20 | 4.6 | |
| 23 | | 29.2 | | 3.0 | 0.18 | 6.0 | Regularly machined |
| 24 | | 45 | | 1.5 | 0.15 | 7.4 | surface without macro irregularities |
| 25 | | 18 | | 4.0 | 0.24 | 4.3 | Irregularly |
| 26 | 90 | 10 | | 3.0 | 0.40 | 4.2 | machined |
| 27 | | 90 | | 0.2 | 0.37 | 5.4 | surface |
| 28 | | 100 | 1.0 | 0.3 | 0.27 | 4.7 | |
| 29 | | 12 | 1.0 | 1.5 | 0.38 | 4.0 | |
| 30 | | 24.4 | | 0.2 | 0.32 | 4.3 | |
| 31 | 122 | 70 | | 4.0 | 0.22 | 4.2 | |
| 32 | | 135 | | 3.0 | 0.25 | 4.5 | |
| 33 | | 122 | | 0.3 | 0.15 | 6.9 | Regularly machined |
| 34 | 146 | 29.2 | | 3.0 | 0.16 | 6.0 | surface |
| 35 | 90 | 45 | | 1.5 | 0.12 | 7.7 | without |
| 36 | 122 | 122 | | 0.3 | 0.10 | 8.1 | macro irregularities (marks, scratches, embedded abrasive particles) |

We claims:

1. A device for external magnetic abrasive machining of cylindrical components comprising an electromagnetic system incorporating a pair (2) of pole pieces (4) mounted opposite each other so as to form an annular working zone (9), and a mechanism (16) for feeding the component longitudinally into the working zone CHARACTERIZED in that the electromagnetic system is provided with an additional pair (3) of pole pieces (5) mounted opposite the first pair (2) and displaced with respect to the latter, lengthwise a longitudinal axis ($O_1$—$O_1$) of a component (15) to be machined, for a distance L=(0.2 to 1.0)D, where D is the diameter of the pole pieces (4,5), said pole pieces (4,5) in each of the pairs (2,3) being kinematically associated with each other, set on a common axis of rotation (O—O) and featuring an oppositely directed eccentricity (e) with respect to that axis.

* * * * *